United States Patent [19]

Lang

[11] Patent Number: 4,604,770

[45] Date of Patent: Aug. 12, 1986

[54] SELECTIVELY ADJUSTABLE HINGE

[76] Inventor: Thomas J. Lang, 326 Chardon Ave. Extension, Chardon, Ohio 44024

[21] Appl. No.: 660,960

[22] Filed: Oct. 15, 1984

[51] Int. Cl.[4] ..... E05D 15/00

[52] U.S. Cl. ..... 16/363; 16/375

[58] Field of Search ..... 16/343–345, 16/347, 349, 363, 374–376, 239; 403/117, 116, 113

[56] References Cited

U.S. PATENT DOCUMENTS

| | | | |
|---|---|---|---|
| 1,822,260 | 9/1931 | Adams | 403/113 |
| 3,731,342 | 5/1973 | Cousin | 16/349 |
| 4,332,499 | 6/1982 | Stucheli | 403/116 |
| 4,337,764 | 7/1982 | Lerman | 403/116 |

FOREIGN PATENT DOCUMENTS

| | | | |
|---|---|---|---|
| 6806262 | 11/1969 | Netherlands | 16/374 |
| 1079354 | 8/1967 | United Kingdom | 16/374 |

*Primary Examiner*—Donald R. Schran
*Assistant Examiner*—James L. Wolfe
*Attorney, Agent, or Firm*—Baldwin, Egan & Fetzer

[57] ABSTRACT

A selectively pivotal hinge including first and second hinge elements pivotally connected together about a pivot point. The inner portion of the first hinge element is formed into a circular dial disk having a plurality of spaced transverse peripheral apertures adjacent its periphery and having a transverse central aperture at the hinge pivot point. A stem is slidably disposed in the central aperture. A biasing element in the form of a coiled spring contacts the first hinge element and the stem to bias the stem toward the disk. The second hinge element has an abutment which projects toward the hinge pivot point and is disposed below the disk. Two radial dial arms are rotatably secured to the stem at one longitudinal point thereon for circumferential rotation on the stem. The arms extend radially outwardly over the disk peripheral apertures. The arms have transverse arm pins thereon extending transversely from the arms for selective placement into selected of the peripheral apertures and are adapted to abut against the abutment on the second hinge element, whereby when the stem and arms are raised outwardly in the central aperture, the arms may be circumferentially rotated on the stem enabling the pins to be placed in preselected disk peripheral apertures to thus abut the abutment and limit pivotal movement of the hinge.

10 Claims, 11 Drawing Figures

SELECTIVELY ADJUSTABLE HINGE

This invention relates to hinge assemblies and more particularly to a hinge having means to preselectively limit the pivotal movement of the hinge.

BACKGROUND OF THE INVENTION

There are many instances wherein the limit of pivotal movement of a hinge is required. In such cases, it is usually essential that the limits of the pivotal movement of the hinge be preselectively adjustable. Prior hinge assemblies of this type have proved to be expensive, cumbersome, unreliable, and difficult to operate.

Therefore, it is an object of the invention to provide a selectively adjustable hinge having very simple means for adjusting the limits of its pivotal movement.

A further object of the invention is to provide a selectively adjustable hinge of the above type that is simple in construction, inexpensive to manufacture, and highly effective in operation.

BRIEF DESCRIPTION OF THE INVENTION

Briefly, the foregoing objects are accomplished by the provision of a selectively pivotal hinge including planar first and second hinge elements pivotally connected together about a pivot point. The inner portion of the first hinge element is formed into a circular dial disk with a circular degree scale thereon and having a plurality of spaced transverse peripheral apertures adjacent its periphery in registry with the degree scale and having a transverse central aperture at the hinge pivot point. A stem with a hand knob thereon is slidably disposed in the central aperture. Bias means in the form of a compressed coiled spring is compressed between the first hinge element and a collar on the bottom of the stem to bias the stem toward the disk. The second hinge element has an abutment which projects toward the hinge pivot point and is disposed below the disk. Two radial arms are rotatably secured to the stem at one longitudinal point thereon for circumferential rotation on the stem. The arms extend radially outwardly over the disk peripheral apertures. The arms have transverse pins thereon extending transversely from the arms for selective placement into selected of the peripheral apertures and are adapted to abut against the abutment on the second hinge element, whereby when the stem and arms are raised outwardly in the central aperture, the arms may be circumferentially rotated on the stem enabling the pins to be placed in preselected disk peripheral apertures to thus abut the abutment and limit pivotal movement of the hinge.

In one form of the invention, a second dial disk is spaced from the first dial disk and is disposed between the first dial disk and the second hinge element, such second dial disk having a plurality of spaced transverse peripheral apertures disposed in co-registry with the peripheral apertures on the first dial disk, whereby when a transverse pin is inserted into a first-named circular dial disk peripheral aperture it is also inserted into a coacting peripheral aperture in the second dial disk to thus reinforce and stabilize the pins when they abut the abutment which extends into the space between the first and second disks.

Other objects and advantages of the invention will be apparent from the following description taken in conjunction with the drawings wherein.

In the drawings, like numbers and letters are used to identify like and similar parts throughout the several views.

DESCRIPTION OF THE PREFERRED EMBODIMENTS

Figure 1:
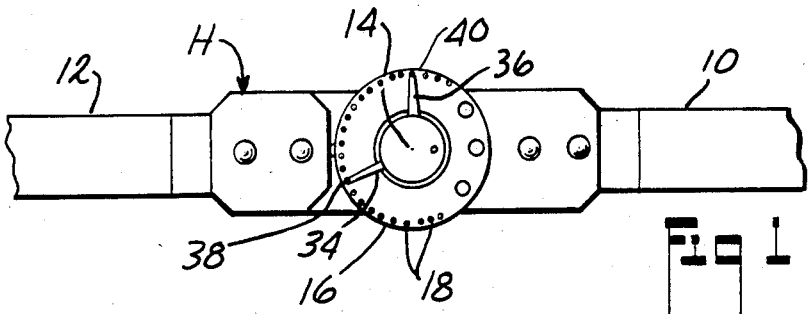
FIG. 1 is a portional top plan view of a selectively adjustable hinge constructed in accordance with the invention.

Referring first to FIGS. 1–8 and 11 there is shown a selectively pivotal hinge H of the invention and including planar first and second hinge elements 10 and 12 pivotally connected together by a hinge joint 11 about a pivot point 14. The inner portion of the first hinge element 10 is formed into a circular dial disk 16 with a circular degree scale 17 thereon (FIG. 7) and having a plurality of spaced transverse peripheral apertures 18 adjacent its periphery in registry with the degree scale and having a transverse central aperture 20 at the hinge pivot point 14. The disk 16, in the preferred form, is formed integral with a spaced second disk 19 later to be described.

A stem 22 with a hand knob 24 thereon is slidably disposed in the central aperture 20. Bias means in the form of a compressed coiled spring 26 is compressed between the first hinge element 10 and a collar 27 on the bottom of the stem 22 to bias the stem downward toward the disks 16 and 19. Collar 27 coacts with the defining surface of central aperture 20 and guides lengthwise movement of the stem 22 in aperture 20, as can be seen from FIG. 11.

The second hinge element 12 has planar plate 28 thereon which carries an abutment 30. The abutment 30 projects toward the hinge pivot point 14 and is disposed below the disk 16 and above the disk 19, as shown in FIG. 2.

Two radial arms 34, 36, are rotatably secured to the stem 22 at one longitudinal point 37 thereon for circumferential rotation on the stem thereat. The arms 34, 36, extend radially outwardly over the disk peripheral apertures 18. The arms 34, 36, have transverse pins 38, 40 respectively thereon extending transversely from the arms for selective placement into selected of the peripheral apertures 18, and are adapted to abut against the abutment 30 on the second hinge element 12, whereby when the stem 22 and arms 34, 36, thereon are raised outwardly in the central aperture 20, the arms 34, 36, may be circumferentially rotated on the stem enabling the arm pins 38, 40, to be placed in preselected disk peripheral apertures 18 to thus abut the abutment 30 and limit pivotal movement of the hinge H.

Figure 2:
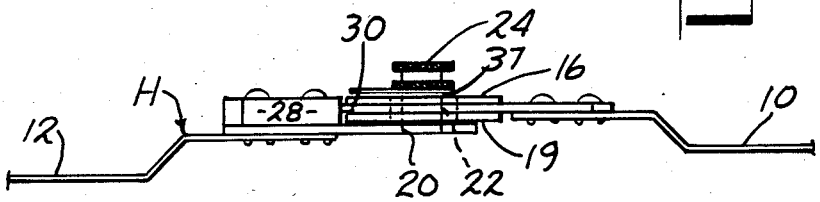
FIG. 2 is a side elevational view of the hinge shown in FIG. 1.
Figure 3:
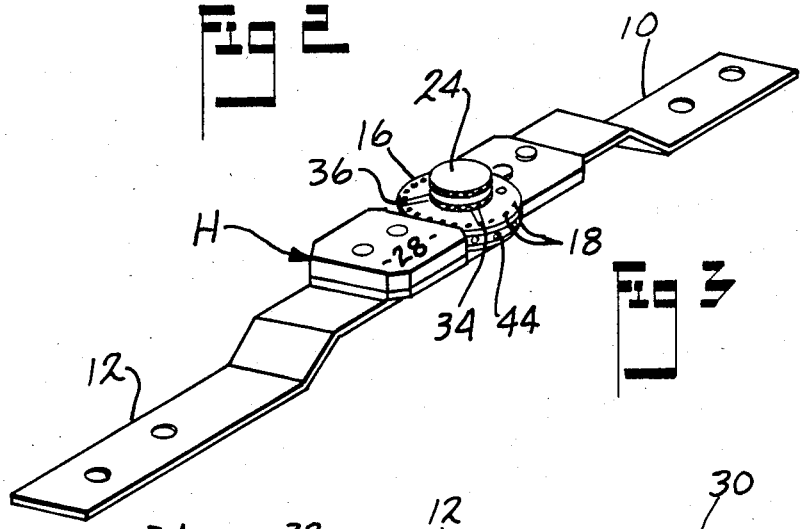
FIG. 3 is an enlarged perspective view of the hinge shown in FIGS. 1 and 2.
Figure 6:
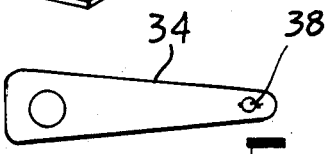
FIG. 6 is a top plan view of the dial arm shown in FIG. 5.
Figure 4:
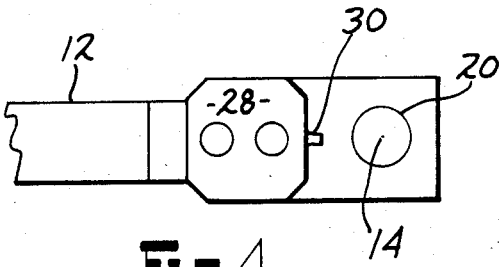
FIG. 4 is a portional top plan view of the left hinge element of the hinge shown in FIG. 1.
Figure 5:
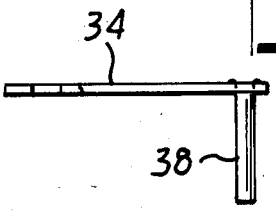
FIG. 5 is an enlarged side elevational view of one of the dial arms shown in FIG. 1.
Figure 7:
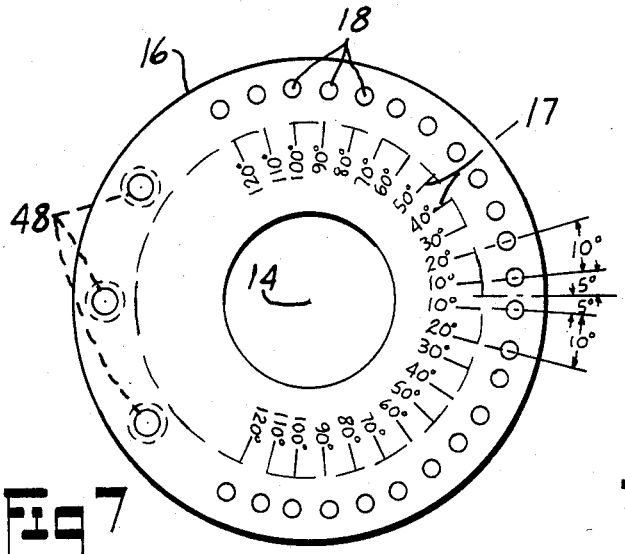
FIG. 7 is an enlarged top plan view of the dial disk shown in FIG. 1.
Figure 8:
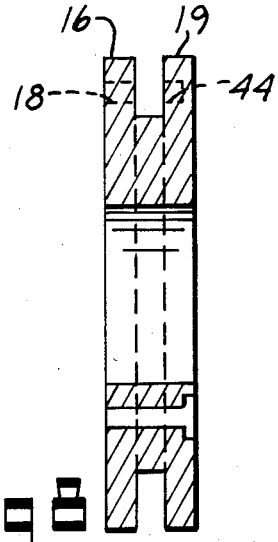
FIG. 8 is a sectional view of the dial disk shown in FIG. 7.

In the preferred form, a second dial disk 19 is spaced from and disposed below the first dial disk 16 as best shown in FIG. 2. The second dial disk 19 has a plurality of spaced transverse peripheral apertures 44 (FIG. 3) disposed in co-registry with the peripheral apertures 18 on the first dial disk 16, whereby when a transverse pin 38, for example, is inserted into a first circular dial disk peripheral aperture 18 (FIG. 8), it is also inserted into a coacting peripheral aperture 44 in the second dial disk 19 to thus reinforce and stabilize the pins when they abut the abutment 30. It is preferred that the disks 16 and 19 be formed integral, as shown in FIG. 8, and secured to the hinge element 10 by the rivets 48 (FIG. 7).

Figure 10:
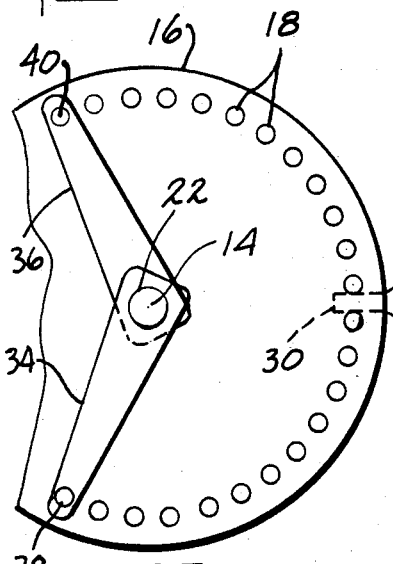
FIG. 10 is a view similar to FIG. 9 but showing the arm pins in maximum pivotal position to allow maximum pivoting of the hinge.
Figure 9:
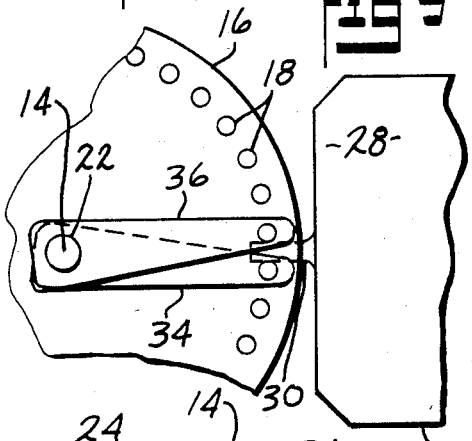
FIG. 9 is a portional enlarged top plan view of the dial disk and two dial arms thereon of FIG. 1, with the dial arms being disposed in hinge locking position wherein the arm pins straddle the abutment on the other hinge element to prevent pivotal movement of the hinge.
Figure 11:
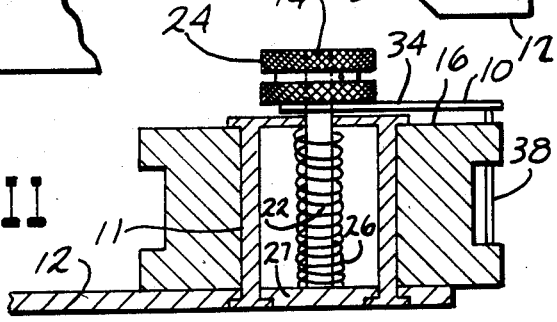
FIG. 11 is a portional enlarged side elevational sectional view of the central stem portion of the hinge shown in FIG. 2.

FIG. 9 shows the arms 34, 36, in position for zero pivotal movement of the hinge H, and FIG. 10 shows the arms in position for maximum (240°) pivotal movement of the hinge.

There are many possible applications for a selectively pivotal hinge of the invention. One common application is for use as a knee or arm stabilizing hinge for attachment to the side of a knee or arm to limit bending thereof during the healing process, but it is to be understood that the invention is not to be limited to such application.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A selectively pivotal hinge comprising a hinge having two hinge elements pivotally connected together about a pivot point for free pivotal movement relative to one another with one of said hinge elements having a projecting an abutment thereon, said abutment projecting generally longitudinally of said one hinge element in overlapping relation to said other hinge element, and hinge adjustment means disposed on the other hinge element coacting with the hinge pivot point for selectively changing the limit of pivotal movement of the hinge in coaction with said abutment, and wherein said hinge adjustment means comprises an arm disposed in a plane generally parallel to the planes of pivotal movement of said hinge elements and pivoted to the other hinge element at the hinge pivot point for pivotal movement of said arm relative to said hinge elements in the first mentioned plane, said arm including a transverse pin fixed to said arm and projecting into a selected one of a series of spaced complementally sized openings in said other hinge element and into the path of said abutment to limit the range of relative pivotal movement between said hinge elements, said arm and pin being non-pivotal relative to said other hinge element when said pin projects into the selected of said openings, and means coacting with said arm at said pivot point enabling said arm and pin to be moved as a unit generally parallel to and transverse to said planes and generally parallel to and transverse relative to said hinge elements away from the latter, to remove said pin from said abutment path, thus permitting a greater range of said relative pivotal movement between said hinge elements.

2. A selectively pivotal hinge comprising a first hinge element, a second hinge element pivotally connected to said first hinge element about a pivot point, the inner portion of said first hinge element including a circular dial disk having a plurality of spaced transverse peripheral apertures adjacent its periphery and having a transverse central aperture at the hinge pivot point, a stem slidably disposed in said central aperture, bias means contacting the stem to bias the stem toward the disk, said second hinge element having an abutment projecting longitudinally of said second hinge element toward the hinge pivot point and disposed below the said disk, and two radial dial arms rotatably secured to the stem at one longitudinal point on the stem for circumferential rotation on the stem and in planes generally parallel to the planes of relative pivotal movement of said hinge elements, and extending radially outwardly over the disk peripheral apertures, each of said arms having a respective transverse arm pin thereon extending transversely from the respective arm for placement into selected of said peripheral apertures, and upon relative pivotal movement of said hinge elements adapted for abutment against said abutment, to limit said relative pivotal movement between said hinge elements, whereby when said stem and arms are raised outwardly in the central aperture relative to said hinge elements, the pins may be placed in other selected disk peripheral apertures to thus provide for a different engagement of the pins with the abutment and change the limit of pivotal movement of the hinge elements relative to one another.

3. The structure of claim 3 wherein said stem has a knob thereon enabling the stem to be grasped by hand and easily raised outwardly out of the central aperture against the action of the bias means.

4. The structure of claim 3 wherein said stem includes a collar adjacent one end in aaid central aperture, said bias means engaging said collar for urging said stem and said arms inwardly of said aperture and toward the dial, said collar coacting with the defining surface of said aperture and guiding the lengthwise movement of said stem in said aperture.

5. The structure of claim 2 wherein said circular dial disk has a circular degree scale thereon disposed in co-registry with said peripheral apertures for indicating the degree of angularity for each peripheral aperture.

6. The structure of claim 2 and further including a second dial disk disposed between said first-named dial disk and said second hinge element and being spaced from but being rigidly connected to said first-named disk, said second dial disk having a plurality of spaced transverse peripheral apertures disposed in co-registry with the peripheral apertures on the first-named dial disk, whereby when a transverse pin of a respective arm is inserted into a first-named circular dial disk peripheral aperture it is also inserted into a coacting peripheral aperture in the second dial disk to thus reinforce and stabilize the pins when they abut the abutment.

7. The structure of claim 6 and further including a plate secured to said second hinge element, said abutment being disposed on said plate in a position opposite said circular dial disks and projecting into the space between said dial disks, said arms being pivotal relative to said disks to locate said pins in selected of said apertures to either lock said hinge elements against said relative pivotal movement or to permit a selected range of said relative pivotal movement of said hinge elements.

8. The structure of claim 6 wherein said first dial disk and said second dial disk are integrally formed together with said first and second dial disks being fastened to said first hinge element, said abutment on said second hinge element projecting longitudinally of said second hinge element and between said first and second disks toward said pivot point and beyond an imaginary arcuate surface containing the axes of said apertures in said first and second dial disks, said stem having a knob thereon enabling said stem to be grasped by hand and raised out of said central aperture against the resistance of said bias means, thereby withdrawing each of said pins out of its respective disk apertures, and providing for adjustment of the selected ones of said disk apertures in which said pins are received, said stem having a collar adjacent its distal end against which said bias means bears for causing compression of said bias means upon outward lengthwise movement of said stem relative to said central aperture, said collar guiding said lengthwise movement of said stem and arms in said outward movement, said hinge elements being generally planar, said knob in conjunction with said rotatable arms and transverse pins providing upon said raising of said stem out of said central aperture and said withdrawal of said pins from said respective apertures, for convenient adjustment of the operative position of said pins relative to said abutment on said second hinge element, thereby providing for varying the range of relative pivotal movement of said hinge elements with respect to one another, said peripheral disk apertures in said to one another, said peripheral disk apertures in said first-named disk extending completely through the latter, while said peripheral disk apertures in said second disk terminate short of extending through said second disk, said arms being spaced outwardly from said first-named disk when said pins are received in the respective aligned disk apertures in said disks and restrict the range of pivotal movement of said hinge elements relative to one another.

9. The structure of claim 2 wherein said hinge elements are planar.

10. A knee or arm stabilizing hinge for attachment to the side of a knee or arm joint to limit bending thereof comprising, an upper generally planar hine element, a generally planar lower hinge element, hinge joint means pivotally connecting said upper and lower hinge elements and defining a central aperture, the inner portion of said upper hinge element being formed into a circular dial having a plurality of spaced transverse peripheral apertures on its periphery and having a transverse central aperture at the hinge pivot point receiving therethrough said hinge joint means, a stem slidably disposed in said central aperture of said joint means, and a coil spring compressed between said joint means and the stem to bias the stem toward the dial, said lower hinge element having an abutment projecting toward the hinge pivot point and disposed below the dial, said stem having two radial dial arms rotatably secured thereto for circumferential rotation on the stem in planes generally parallel to the planes of relative pivotal movement of said hinge elements, and extending radially outwardly over the dial peripheral apertures, said arms having transverse arm pins thereon extending transversely for selective placement into certain of said peripheral apertures and when in the last mentioned apertures being abutable against said abutment to limit said relative pivotal movement of said hinge elements, and whereby when said stem and arms are raised against the resistance of said spring outwardly in the central aperture so as to withdraw said pins from the respective of said dial apertures, the pins may be placed in other of the dial peripheral apertures to thus abut the abutment and change the limit of relative rotation of the hinge elements about the hinge pivot point.

* * * * *